US006513007B1

(12) United States Patent
Takahashi

(10) Patent No.: US 6,513,007 B1
(45) Date of Patent: Jan. 28, 2003

(54) GENERATING SYNTHESIZED VOICE AND INSTRUMENTAL SOUND

(75) Inventor: Akio Takahashi, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/619,955

(22) Filed: Jul. 20, 2000

(30) Foreign Application Priority Data

Aug. 5, 1999 (JP) ..... 11-222809

(51) Int. Cl.[7] ..... G10L 13/04; G10L 13/06
(52) U.S. Cl. ..... 704/258; 704/263; 704/265
(58) Field of Search ..... 704/258–269

(56) References Cited

U.S. PATENT DOCUMENTS 3,624,301 A * 11/1971 Richeson ..... 704/258
4,577,343 A * 3/1986 Oura ..... 704/258
4,907,484 A 3/1990 Suzuki et al.
5,111,727 A 5/1992 Rossum
5,247,130 A 9/1993 Suzuki et al.
5,250,748 A 10/1993 Suzuki
5,694,522 A * 12/1997 Hiratsuka et al. ..... 704/258
5,744,742 A 4/1998 Lindemann et al.
5,826,232 A * 10/1998 Gulli ..... 704/258
5,864,812 A * 1/1999 Kamai et al. ..... 704/258
6,073,100 A * 6/2000 Goodridge, Jr. ..... 704/258
6,253,182 B1 * 1/2001 Acero ..... 704/258

FOREIGN PATENT DOCUMENTS

JP 5204397 8/1993 ..... G10L/9/04

OTHER PUBLICATIONS

Gibson et al ("Real–Time Singing Synthesis using a Parallel Processing System", IEE Colloquium on Audio and Music Technology: The Challenge of Creative DSP, Nov. 18, 1998).*

* cited by examiner

*Primary Examiner*—Richemond Dorvil
*Assistant Examiner*—Daniel A Nolan
(74) *Attorney, Agent, or Firm*—Pillsbury Winthrop LLP

(57) ABSTRACT

There is provided a synthesized sound generating apparatus and method which can achieve responsive and high-quality speech synthesis based on a real-time convolution operation. Coefficients are generated by using dynamic cutting to extract characteristic information from a first signal. A convolution operation is performed on a second signal using the generated coefficients to generate a synthesized signal. As the convolution operation, an interpolation process is performed on the coefficients to prevent a rapid change in level of the generated synthesized signal upon switching of the coefficients.

13 Claims, 7 Drawing Sheets

VOICE INPUT
INSTRUMENTAL INPUT
A/D
1-1
A/D
1-2
DSP
2-1
DSP
2-2
RAM
4
CPU
5
CNV
3
DSP
6
D/A
7
SYNTHESIZED SPEECH SIGNAL OUTPUT

GENERATING SYNTHESIZED VOICE AND INSTRUMENTAL SOUND

BACKGROUND OF THE INVENTION

1. Field of the Invention

The present invention relates to a synthesized sound generating apparatus and method which is suitable for inputting and synthesizing voices and instrumental sounds and outputting synthesized instrumental sounds or the like having characteristic information on the voices.

2. Prior Art

Vocoders, which have a function for analyzing and synthesizing voices, are commonly used with music synthesizers due to their ability to onomatopoeically generate instrumental sounds, noise, or the like. Major known developed vocoders include formant vocoders, linear predictive analysis and synthesis systems (PARCO analysis and synthesis), cepstrum vocoders (speech synthesis based on homomorphic filtering), channel vocoders (what is called Dudley vocoders), and the like.

The formant vocoder uses a terminal analog synthesizer to carry out sound synthesis based on parameters for vocal tract characteristics determined from a formant and an anti-formant of a spectral envelope, that is, pole and zero points thereof. The terminal analog synthesizer is comprised of a plurality of resonance circuits and antiresonance circuits arranged in cascade connection for simulating resonance/antiresonance characteristics of a vocal tract. The linear predictive analysis and synthesis system is an extension of the predictive encoding method, which is most popular among the speech synthesis methods. The PARCO analysis and synthesis system is an improved version of the linear predictive analysis and synthesis system. The cepstrum vocoder is a speech synthesis system using a logarithmic amplitude characteristic of a filter and inverse Fourier transformation and inverse convolution of a logarithmic spectrum of a sound source.

The channel vocoder uses bandpass filters 10-1 to 10-N for different bands to extract spectral envelope information on an input speech signal, that is, parameters for the vocal tract characteristics, as shown in FIG. 1, for example. On the other hand, a pulse train generator 21 and a noise generator 22 generate two kinds of sound source signals, which are amplitude-modulated using the spectral envelope parameters. This amplitude modulation is carried out by multipliers (modulators) 30-1 to 30-N. Modulated signals output from the multipliers (modulators) 30-1 to 30-N pass through bandpass filters 40-1 to 40-N and are then added together by an adder 50 whereby a synthesized speech signal is generated and output.

In the example of the channel vocoder disclosed in Japanese Laid-Open Patent Publication (Kokai) No. 05-204397, outputs from the bandpass filters 10-1 to 10-N are rectified and smoothed when passing through short-time average-amplitude detection circuits 60-1 to 60-N. A voice sound/unvoiced sound detector 71 determines a voice sound component and an unvoiced sound component of the input speech signal, and upon detecting the voice sound component, the detector 71 operates a switch 23 so as to select and deliver an output (pulse train) from the pulse train generator 21 to the multipliers 30-1 to 30-N. In addition, upon detecting the unvoiced sound component, the voice sound/unvoiced sound detector 71 operates the switch 23 so as to select and deliver an output (noise) from the noise generator 22 to the multipliers 30-1 to 30-N. At the same time, a pitch detector 72 detects a pitch of the input speech signal to cause it to be reflected in the output pulse train from the pulse generator 21. Thus, when the voice sound component is detected, the output from the pulse generator 21 contains pitch information, which is among characteristic information on the input speech signal.

According to the above described formant vocoder, however, since the formant and anti-formant from the spectral envelope cannot be easily extracted, the formant vocoder requires a complicated analysis process or manual operation. The linear predictive analysis and synthesis system uses an all-pole model to generate sounds and uses a simple mean square value of prediction errors, as an evaluative reference for determining coefficients for the model. Thus, this method does not focus on the nature of voices. The cepstrum vocoder requires a large amount of time for spectral processing and Fourier transformation and is thus insufficiently responsive in real time.

On the other hand, the channel vocoder directly expresses the parameters for the vocal tract characteristics in physical amounts in the frequency domain and thus takes the nature of voices into consideration. Due to the lack of mathematical strictness, however, the channel vocoder is not suited for digital processing.

SUMMARY OF THE INVENTION

There is provided a synthesized sound generating apparatus and method which can achieve responsive and high-quality speech synthesis based on a real-time convolution operation. Coefficients are generated by using dynamic cutting to extract characteristic information from a first signal. A convolution operation in the time domain is performed on a second signal using the generated coefficients to generate a synthesized signal. An interpolation process is performed on the coefficients to prevent a rapid change in level of the generated synthesized signal upon switching of the coefficients.

DETAILED DESCRIPTION OF PREFERRED EMBODIMENTS

The present invention will be described below in detail with reference to the drawings showing preferred embodiments thereof.

Figure 1:
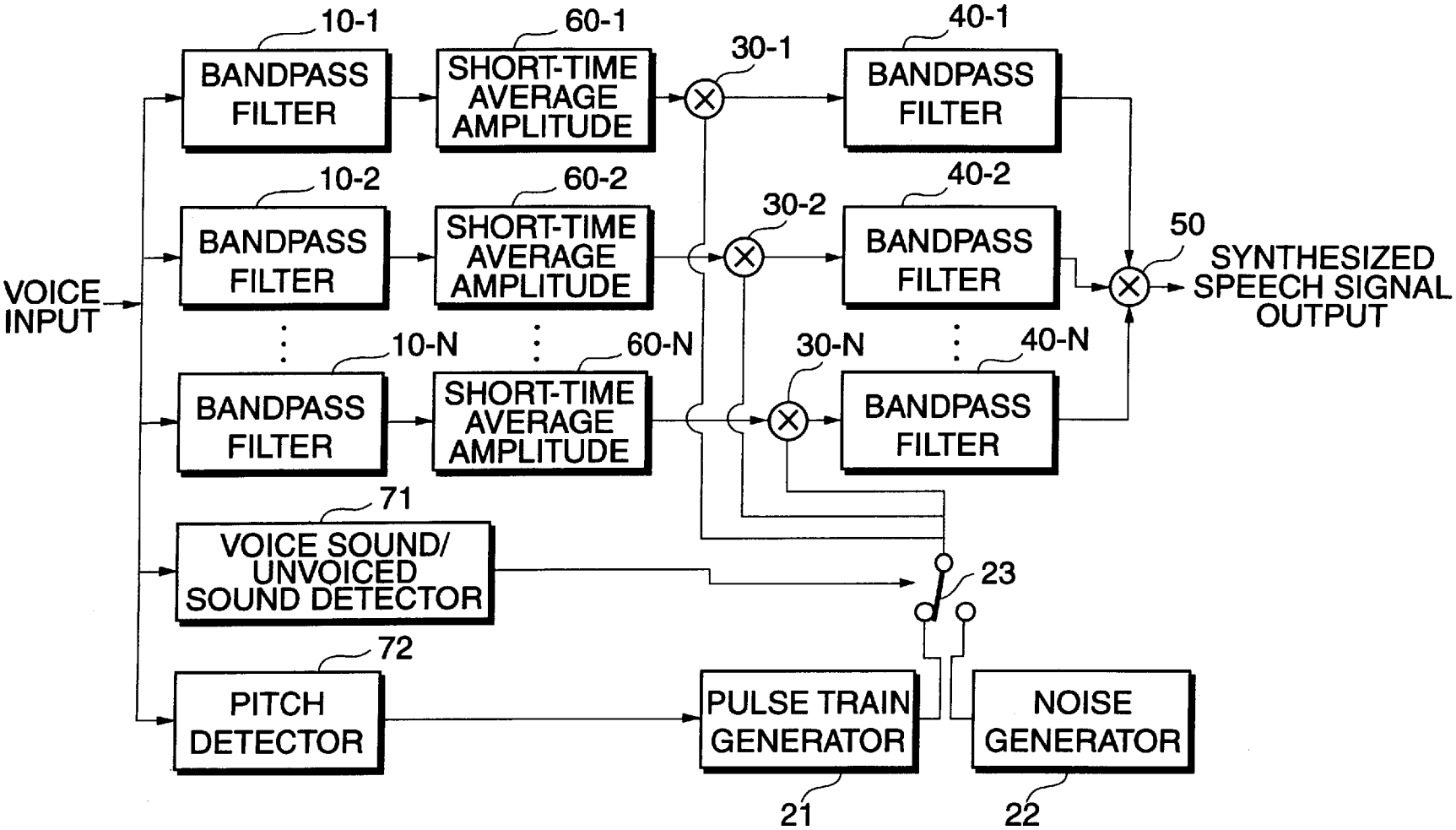
FIG.1 PRIOR ART
FIG. 1 is a block diagram showing an example of a conventional vocoder.
Figure 2:
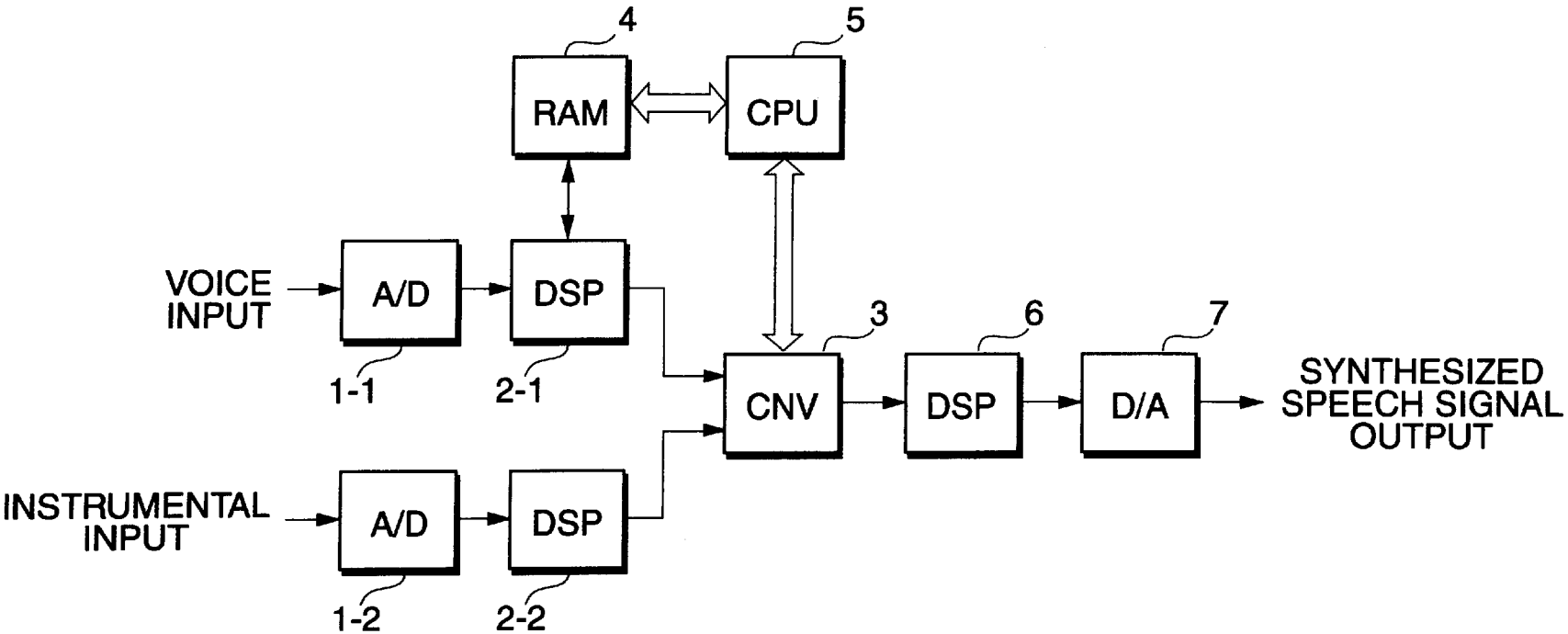
FIG. 2 is a block diagram showing the construction of a synthesized sound generating apparatus according to an embodiment of the present invention.

FIG. 2 is a block diagram showing the construction of a synthesized sound generating apparatus according to an embodiment of the present invention. In this embodiment, the synthesized sound generating apparatus according to the present invention is applied to a vocoder to generate a synthesized signal by dynamically cutting out waveforms from an analog speech signal (a first signal) input from a microphone or the like, to extract characteristic information therefrom to thereby generate coefficients and convoluting the generated coefficients into an analog instrumental sound signal (or a music signal (second signal) from an electric guitar, a synthesizer, or the like.

The input analog speech signal is converted into a digital value (digital speech signal) by an AD converter 1-1. At the same time, an input analog instrumental-sound signal is converted into a digital value (digital instrumental-sound signal) by an AD converter 1-2. Outputs from the AD converters 1-1, 1-2 are processed by digital signal processors (DSP) 2-1, 2-2, respectively.

The digital signal processor 2-1 subjects the digital speech signal from the AD converter 1-1 to sound pressure control and sound quality correction, and cuts out sound waveforms from the speech signal at predetermined time intervals of, for example, 10 to 20 ms to generate coefficients h, which are transmitted to a convolution circuit (CNV) 3. The digital signal processor 2-2 subjects the digital instrumental-sound signal to sound pressure control and sound quality correction to supply the processed signal to the convolution circuit 3 as data.

The sound pressure control by the digital signal processors 2-1, 2-2 comprises correcting and controlling, for example, the sound pressure level (dynamic range), and the sound quality correction comprises correcting the frequency characteristic. Further, the sound pressure control includes creating sound characters. Also low-frequency range noise from the microphone is cut off.

The convolution circuit 3 performs a convolution operation based on the coefficients h output from the digital signal processor 2-1 and the data output from the digital signal processor 2-2. The coefficients are updated at the same time intervals (cycle) as those at which the sound waveforms are cut out, that is, every 10 to 20 ms.

Figure 3:
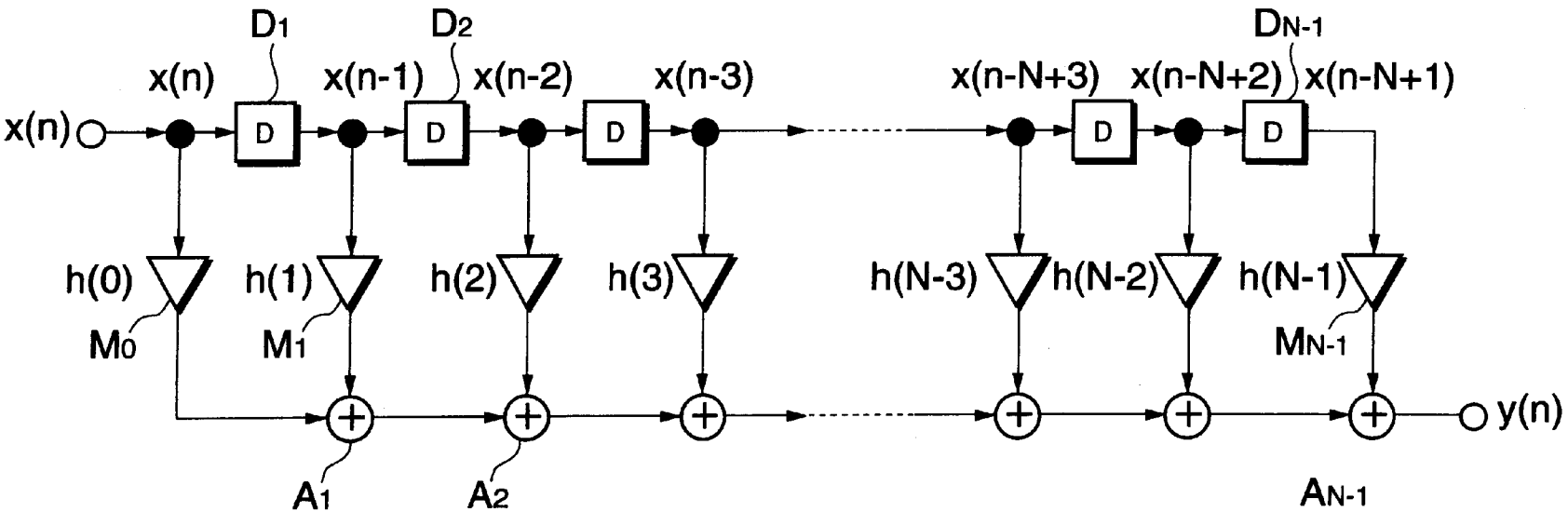
FIG. 3 is a view useful in explaining a convolution operation.

The convolution circuit 3 executes the convolution operation in a manner such as one shown in FIG. 3. That is, an input x(n), which is output data from the digital signal processor 2-2, is sequentially delayed by one-sample delay devices D1 to DN-1. Then, multipliers MO to MN-1 multiply the input x(n) and signals x(n−1) to x(n−N+1) obtained by delaying the input x(n), by the coefficients h(0) to h(N-1) output from the digital signal processor 2-1, respectively. Outputs from the multipliers MO to MN-1 are sequentially added together by adders Al to AN-1, to obtain an output y(n).

Thus, the output y(n) is expressed by Equation 1 given below:

$$y(n) = \sum_{i=0}^{N-1} h(i) * x(n-i)$$

This convolution operation is realized by a well-known FIR (finite impulse response) filter. With a small filter length, the filter acts as an equalizer to carry out a frequency characteristic-correcting function, whereas with a large filter length, the filter can execute signal processing called reverberation. In common convolution operations, the coefficients h are fixed, but in the present invention these coefficients are varied. Specifically, in the present invention waveforms of the speech signals cut out at the short time intervals as described above are used as the coefficients. The coefficients are automatically updated in response to the sequentially varying speech signal. The instrumental sound signal thus convoluted with the coefficients as described above is similar to those obtained through processing by the conventional vocoders.

The coefficient switching cycle is preferably between 10 and 20 ms for both men and women. The waveform cutting-out with a fixed cycle, however, results in clip noise or distortion in the signal, which is aurally sensed. To avoid this, the digital signal processor 2-1 obtains the coefficients h used for the convolution operation by dynamically cutting out waveforms in such a manner that each waveform starts at a zero cross point and ends at another zero cross point separated from the first one by a time interval which is close to a reference switching cycle Δt.

Figure 4:
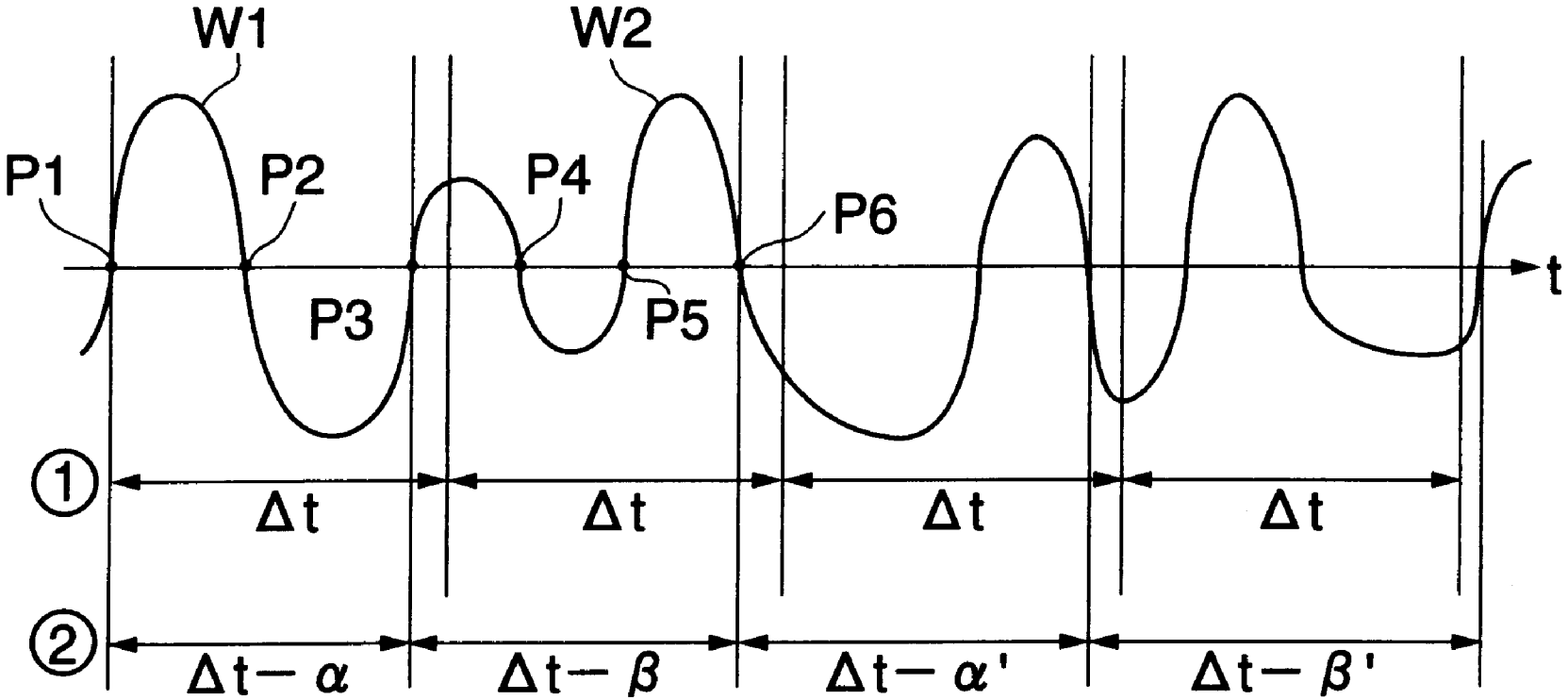
FIG. 4 is a waveform diagram useful in explaining a manner of dynamically cutting out waveforms used as coefficients.

For example, if the input speech signal varies as shown in FIG. 4 and when waveforms W1 and W2 are cut out with the fixed switching cycle Δt, there is a high probability that the start and end points of each waveform do not coincide with zero cross points P1, P2, . . . , and P6. Thus, the digital signal processor 2-1 dynamically varies the cutting-out cycle. Specifically, the waveform cutting-out is executed by determining from actual waveforms, time intervals Δt−α, Δt—β, Δt—α', and Δ+β', each corresponding to a section between two zero cross points which is close to the fixed switching cycle Δt.

A similar technique is known from a sound waveform cutting-out device used in a speech synthesis apparatus proposed by Japanese Laid-Open Patent Publication (Kokai) No. 7-129196. The object of this patent, however, is to generate waveforms for one pitch and is not directed to the convolution coefficients for vocoders. The pitch information is not so important to the vocoder according to the present invention because it updates the coefficients through interpolation.

Figure 5A:
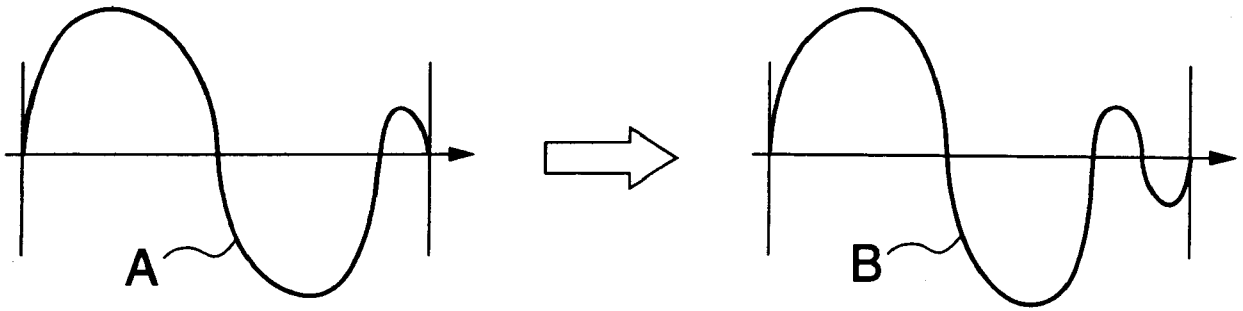
FIG. 5A is a waveform diagram useful in explaining a manner of coefficient interpolation carried out in switching from a coefficient A to a coefficient B.
Figure 5B:
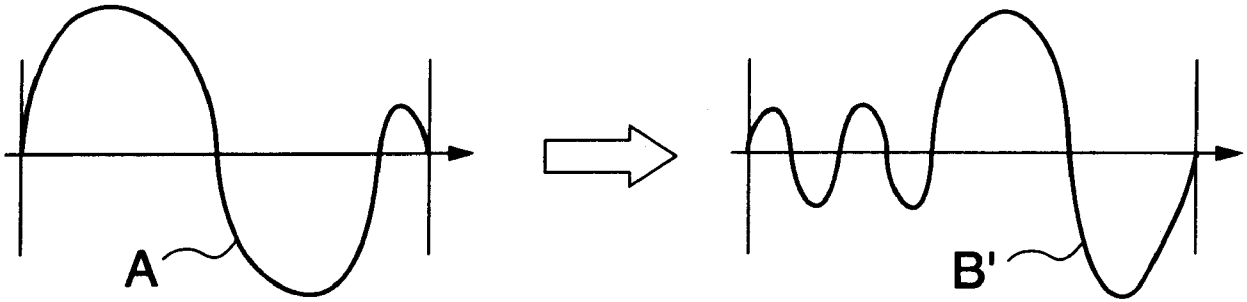
FIG. 5B is a waveform diagram useful in explaining a manner of coefficient interpolation carried out in switching from the coefficient A to a coefficient B'.

Even if the dynamically cut-out coefficients are used for the convolution operation as described above, if a coefficient A has a waveform passing through zero cross points as shown in FIGS. 5A and 5B, the waveform of the actually output synthesized signal undergoes a rapid change in level when the coefficient A is instantaneously switched to the next coefficient B. This may also result in clip noise or distortion, which is aurally sensed. To avoid such a rapid change in level, the convolution circuit 3 in FIG. 2 slowly switches from the coefficient A to the next coefficient B' by executing an interpolation over a period of time substantially equal to the cutting-out interval, as shown in FIG. 5B. This solves the noise or distortion problem.

Various interpolation operation methods may be applied to the above interpolation, among which the linear interpolation is simplest. According to the linear interpolation, if the interpolation time is denoted by c [ms], the initial coefficient value by a, and the final coefficient value by b, then the coefficient value obtained a time x=t [ms] after the start of the interpolation is f(x)=(b−a)/c*x+a when x≦c and f(x)=b when x>c. In fact, a new final coefficient value is set when x=c, to start a new coefficient interpolation.

The coefficients generated by the digital signal processor 2-1 through the above described processing are stored in a memory (RAM) 4. The coefficients are then supplied to the convolution circuit 3 under the control of a CPU 5. An output from the convolution circuit 3 is imparted with effects such as sound quality correction and echoes by a digital signal processing circuit 6, and is then converted back into an analog signal by a D/A converter 7 to be output as a synthesized speech signal.

Figure 6:
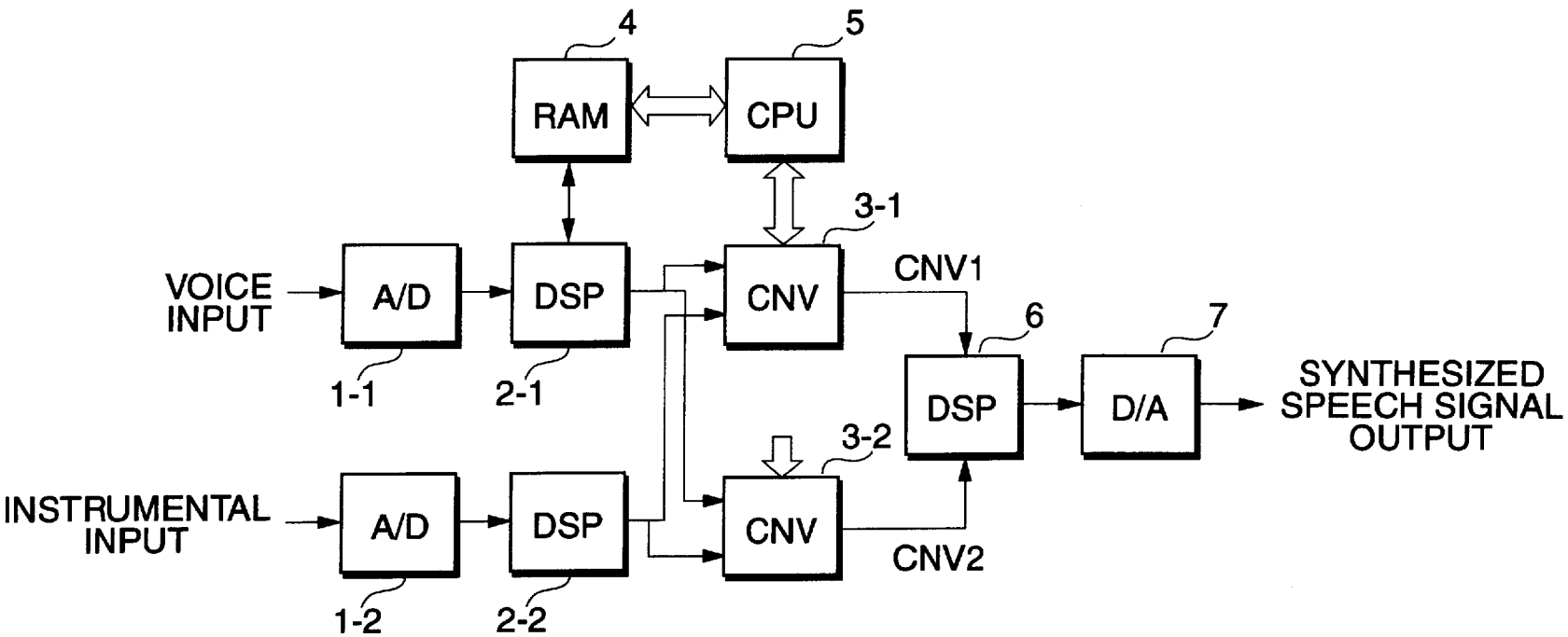
FIG. 6 is a block diagram showing the construction of a synthesized sound generating apparatus according to another embodiment of the present invention.

FIG. 6 shows the construction of a synthesized sound generating apparatus (vocoder) according to another embodiment of the present invention. In the synthesized sound generating apparatus according to the present embodiment, two convolution circuits 3-1, 3-2 are arranged in parallel to carry out a cross fade interpolation process. That is, the two convolution circuits 3-1, 3-2 do not have such an interpolation function as is provided by the convolution circuit 3 in FIG. 2, and are each comprised of an inexpensive LSI.

Similarly to the synthesized sound generating apparatus in FIG. 2, the AD converter 1-1 converts an input analog speech signal into a digital value (digital speech signal). At the same time, the AD converter 1-2 converts an input analog instrumental sound signal into a digital value (digital instrumental sound signal). The digital signal processor 2-1 subjects the digital speech signal from the AD converter 1-1 to sound pressure control and sound quality correction, and cuts out sound waveforms from the speech signal at predetermined time intervals of, for example, 10 to 20 ms to generate the coefficients h, which are transmitted to the convolution circuits (CNV) 3-1 and 3-2. The digital signal processor 2-2 subjects the digital instrumental sound signal to sound pressure control and sound quality correction to supply the processed signal to the convolution circuits 3-1 and 3-2 as data.

The coefficients generated by the digital signal processor 2-1 are temporarily stored in the RAM 4. The coefficients are then supplied to the convolution circuits 3-1 and 3-2 under the control of the CPU 5. The convolution circuits 3-1 and 3-2 each execute a convolution operation based on the coefficients from the digital signal processor 2-1 and the data from the digital signal processor 2-2. Outputs from the convolution circuits 3-1, 3-2 are imparted with effects such as sound quality correction and echoes by the digital signal processing circuit 6, and are then converted back into an analog signal by the D/A converter 7 to be output as a synthesized speech signal. In the present embodiment, the digital signal processor 6 carries out a cross fade process in contrast to the configuration in FIG. 2.

Figure 7:
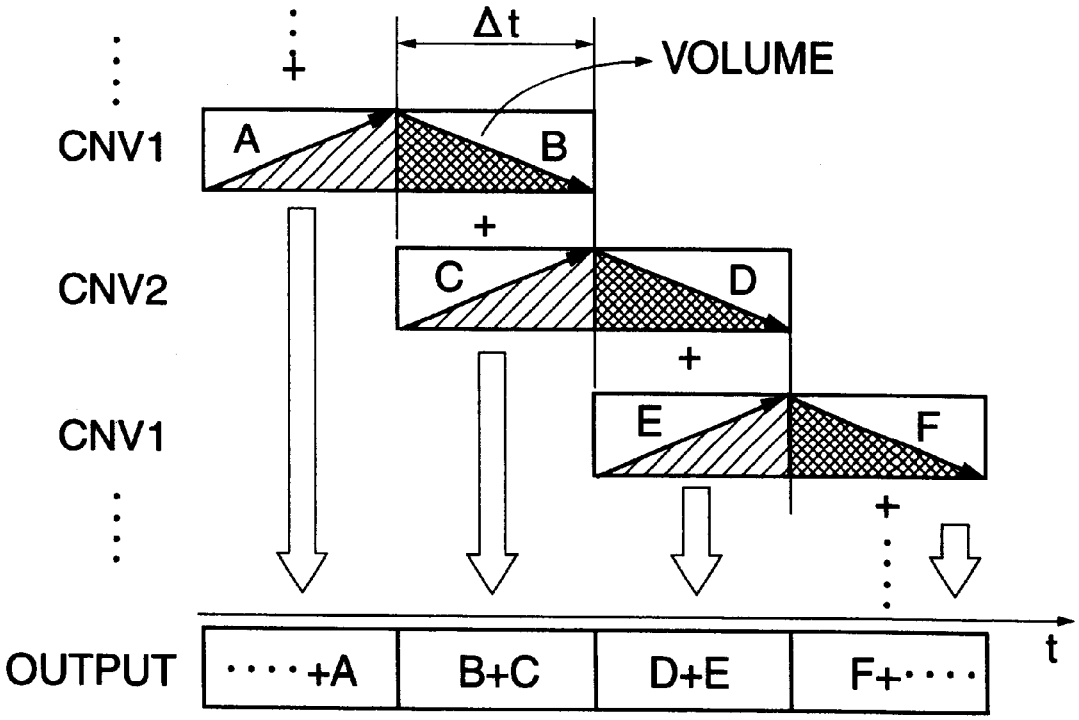
FIG. 7 is a diagram useful in explaining a cross fade process.

The cross fade process executed by the digital signal processor 6 is shown in FIG. 7. That is, the output CNV1 from the first convolution circuit 3-1 and the output CNV2 from the second convolution circuit 3-2 are caused to partly overlap on the time axis and cross each other in such a manner that the latter half of the preceding output is faded out while the former half of the following output is simultaneously faded in, thereby reducing noise which may occur if the coefficients are instantaneously switched. For example, when the latter half B of the output CNV1 is faded out, the former half C of the output CNV2 is simultaneously faded in. Next, when the latter half D of the output CNV2 is faded out, the former half E of the next output CNV1 is simultaneously faded in. In the illustrated example, the length of the section over which the outputs CNV1 and CNV2 overlap each other is made equal to the dynamically varying switching cycle $\Delta t$, previously described with reference to FIG. 4. Therefore, the required length of each waveform cut out by the digital signal processor 2-1 in FIG. 6 is essentially twice or more as large as that in the configuration in FIG. 2.

Therefore, it is an object of the present invention to provide a synthesized sound generating apparatus and method which can achieve responsive and high-quality speech synthesis based on a real-time convolution operation.

To attain the above object, according to a first aspect of the present invention, there is provided a synthesized sound generating apparatus comprising a coefficient generating device that generates coefficients by using dynamic cutting to extract characteristic information from a first signal; and a synthesized signal generating device that carries out a convolution operation on a second signal using the coefficients generated by the coefficient generating device to generate a synthesized signal.

In a preferred embodiment of the first aspect, the synthesized signal generating device comprises a convolution circuit that carries out an interpolation process on the coefficients to prevent a rapid change in level of the generated synthesized signal upon switching of the coefficients.

In a typical example of the first aspect, the first signal is a speech signal, and the characteristic information extracted from the speech signal indicates one waveform starting at a zero cross point and ending at another zero cross point separated from the zero cross point by a time interval close to a reference switching cycle.

Preferably, the time interval is determined from an actual waveform of the speech signal.

In a typical example of the first aspect, the signal is an instrumental sound signal.

To attain the above object, according to a second aspect of the present invention, there is provided a synthesized signal generating apparatus comprising a coefficient generating device that dynamically continuously cuts out waveforms from a first signal in a manner such that adjacent ones of the waveforms cut out from the first signal partly overlap each other, to extract characteristic information therefrom to generate coefficients, a pair of convolution circuits that are operative in parallel, the convolution circuits alternately receiving the coefficients generated from the waveforms continuously cut out by the coefficient generating device and carrying out convolution operations on a second signal using the coefficients to generate a first synthesized signal and a second synthesized signal, respectively, and a cross fade processing device that carries out a cross fade process on the first synthesized signal and the second synthesized signal generated by the pair of convolution circuits, upon switching of the coefficients.

In a typical example of the second aspect, the first signal is a speech signal, and the characteristic information extracted from the speech signal indicates one waveform starting at a zero cross point and ending at another zero cross point separated from the zero cross point by a time interval close to a reference switching cycle.

Preferably, the time interval is determined from an actual waveform of the speech signal.

In a typical example of the second aspect, the second signal is an instrumental sound signal.

To attain the above object, according to a third aspect of the present invention, there is provided a synthesized sound generating method comprising a coefficient generating step of generating coefficients by using dynamic cutting to extract characteristic information from a first signal, and a synthesized signal generating step of carrying out a convolution operation on a second signal using the coefficients generated by the coefficient generating device to generate a synthesized signal.

To attain the above object, according to a fourth aspect of the present invention, there is provided a synthesized signal generating method comprising a coefficient generating step of dynamically continuously cuts out waveforms from a first signal in a manner such that adjacent ones of the waveforms cut out from the first signal partly overlap each other, to extract characteristic information therefrom to generate coefficients, a convolution step of alternately receiving the coefficients generated from the waveforms continuously cut out by the coefficient generating step and carrying out convolution operations on a second signal using the coefficients to generate a first synthesized signal and a second synthesized signal, and a cross fade processing step of carrying out a cross fade process on the first synthesized signal and the second synthesized signal generated by the convolution step, upon switching of the coefficients.

To attain the above object, the present invention further provides a synthesized sound generating apparatus comprising a coefficient generating means for generating coefficients by using dynamic cutting to extract characteristic information from a first signal, and a synthesized signal generating means for carrying out a convolution operation on a second signal using the coefficients generated by the coefficient generating means to generate a synthesized signal.

To attain the above object, the present invention also provides a synthesized signal generating apparatus comprising a coefficient generating means for dynamically continuously cuts out waveforms from a first signal in a manner such that adjacent ones of the waveforms cut out from the first signal partly overlap each other, to extract characteristic information therefrom to generate coefficients, a convolution means for alternately receiving the coefficients generated from the waveforms continuously cut out by the coefficient generating means and carrying out convolution operations on a second signal using the coefficients to generate a first synthesized signal and a second synthesized signal, and a cross fade processing means for carrying out a cross fade process on the first synthesized signal and the second synthesized signal generated by the convolution means, upon switching of the coefficients.

According to the present invention, a real-time convolution operation can be realized to achieve responsive and high-quality speech synthesis. According to the present invention, it is unnecessary to distinguish between the voice sound component and unvoiced sound component of the input speech signal as in the conventional channel vocoder. Further, the present invention can reduce the size of the circuit. The present invention is not limited to speech signals and can accommodate various input signals.

The above and other objects of the invention will become apparent from the following detailed description taken in conjunction with the accompanying drawings.

What is claimed is:

1. A synthesized sound generating apparatus comprising:

a coefficient generating device that generates coefficients by using dynamic continuous cutting to extract characteristic information from a first signal; and a synthesized signal generating device that carries out a time domain convolution operation on a second signal using the coefficients generated by said coefficient generating device to generate a synthesized signal, wherein said synthesized signal generating device includes a convolution circuit that carries out an interpolation process between a present coefficient and a coefficient generated immediately next to said present coefficient of said coefficients to prevent a rapid change in a level of the generated synthesized signal upon switching of said coefficients.

2. A synthesized signal generating apparatus according to claim 1, wherein said convolution circuit carries out said interpolation process over a period of time substantially equal to a period of time over which said dynamic continuous cutting is used by said coefficient generating device.

3. A synthesized signal generating apparatus according to claim 1, wherein said first signal is a speech signal, and said characteristic information extracted from said speech signal indicates one waveform starting at a zero cross point and ending at another zero cross point separated from said zero cross point by a time interval close to a reference switching cycle.

4. A synthesized signal generating apparatus according to claim 3, wherein said time interval is determined from an actual waveform of said speech signal.

5. A synthesized signal generating apparatus according to claim 3, wherein said second signal is an instrumental sound signal.

6. A synthesized signal generating apparatus comprising:

a coefficient generating device that dynamically continuously cuts out waveforms from a first signal in a manner such that adjacent ones of the waveforms cut out from the first signal partly overlap each other, to extract characteristic information therefrom to generate coefficients;

a pair of convolution circuits that are operative in parallel, said convolution circuits alternately receiving said coefficients generated from said waveforms continuously cut out by said coefficient generating device and carrying out convolution operations on a second signal using the coefficients to generate a first synthesized signal and a second synthesized signal, respectively; and a cross fade processing device that carries out a cross fade process on said first synthesized signal and said second synthesized signal generated by said pair of convolution circuits, upon switching of said coefficients.

7. A synthesized signal generating apparatus according to claim 6, wherein wherein said first signal is a speech signal, and said characteristic information extracted from said speech signal indicates one waveform starting at a zero cross point and ending at another zero cross point separated from said zero cross point by a time interval close to a reference switching cycle.

8. A synthesized signal generating apparatus according to claim 7, wherein said second signal is an instrumental sound signal.

9. A synthesized signal generating apparatus according to claim 7, wherein said time interval is determined from an actual waveform of said speech signal.

10. A synthesized sound generating method comprising:

generating coefficients by using dynamic continuous cutting to extract characteristic information from a first signal; and carrying out a time domain convolution operation on a second signal using the generated coefficients to generate a synthesized signal, wherein in said carrying out step, an interpolation process is carried out between a present coefficient and a coefficient generated immediately next to said present coefficient of said coefficients to prevent a rapid change in a level of the generated synthesized signal upon switching of said coefficients.

11. A synthesized signal generating method comprising:

a coefficient generating step of dynamically continuously cuts out waveforms from a first signal in a manner such that adjacent ones of the waveforms cut out from the first signal partly overlap each other, to extract characteristic information therefrom to generate coefficients;

a convolution step of alternately receiving said coefficients generated from said waveforms continuously cut out by said coefficient generating step and carrying out convolution operations on a second signal using the coefficients to generate a first synthesized signal and a second synthesized signal; and a cross fade processing step of carrying out a cross fade process on said first synthesized signal and said second synthesized signal generated by said convolution step, upon switching of said coefficients.

12. A synthesized sound generating apparatus comprising:

a coefficient generating means for generating coefficients by using dynamic continuous cutting to extract characteristic information from a first signal; and a synthesized signal generating means for carrying out a convolution operation on a second signal using the coefficients generated by said coefficient generating means to generate a synthesized signal, wherein said synthesized signal generating means includes a convolution circuit that carries out an interpolation process between a present coefficient and a coefficient generated immediately next to said present coefficient of said coefficients to prevent a rapid change in a level of the generated synthesized signal upon switching of said coefficients.

13. A synthesized signal generating apparatus comprising:

a coefficient generating means for dynamically continuously cuts out waveforms from a first signal in a manner such that adjacent ones of the waveforms cut out from the first signal partly overlap each other, to extract characteristic information therefrom to generate coefficients;

a convolution means for alternately receiving said coefficients generated from said waveforms continuously cut out by said coefficient generating means and carrying out convolution operations on a second signal using the coefficients to generate a first synthesized signal and a second synthesized signal; and a cross fade processing means for carrying out a cross fade process on said first synthesized signal and said second synthesized signal generated by said convolution means, upon switching of said coefficients.

* * * * *